US006910694B2

(12) United States Patent
Hartmann et al.

(10) Patent No.: US 6,910,694 B2
(45) Date of Patent: Jun. 28, 2005

(54) ELECTRICAL TOOL WITH A QUICK-ACTION CLAMPING DEVICE

(75) Inventors: Markus Hartmann, Mauerstetten (DE); Stefan Dorner, Kaufbeuren (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/138,346

(22) Filed: May 3, 2002

(65) Prior Publication Data

US 2002/0170408 A1 Nov. 21, 2002

(30) Foreign Application Priority Data

May 21, 2001 (DE) ..... 101 24 971

(51) Int. Cl.[7] ..... B24B 45/00

(52) U.S. Cl. ..... 279/141; 279/8; 83/698.41; 83/666; 83/665; 83/698.31; 83/676; 403/321

(58) Field of Search ..... 83/666, 698, 665, 83/698.31, 676; 173/213, 132, 217; 30/276, 388; 74/55, 557, 569; 279/141, 8; 403/321

(56) References Cited

U.S. PATENT DOCUMENTS 4,597,227 A * 7/1986 Gentischer et al. ..... 83/698
4,779,382 A * 10/1988 Rudolf et al. ..... 83/666
4,989,374 A * 2/1991 Rudolf et al. ..... 83/666
5,157,873 A * 10/1992 Rudolf et al. ..... 83/666
5,601,483 A * 2/1997 Rudolf et al. ..... 451/359

* cited by examiner

*Primary Examiner*—John Sipos
*Assistant Examiner*—Michelle Lopez
(74) *Attorney, Agent, or Firm*—Sidley Austin Brown & Wood, LLP

(57) ABSTRACT

A quick-action clamping device for a power tool includes a clamping spindle (4) arranged in the hollow spindle (2) of the power tool, an elastic member (5) for biasing the clamping spindle (4) into its clamping poition, in which the working tool is claming between a claming flange (7) provided on a working tool-side end of the claming spindle (4) and the hollow spindle (2), an actuation element (24) for displacing the claming spindle (4) against the biasing force of the elastic member and into its exchange position in which the working tool (3) is released, and a compansator (15) for interrupting action of the elastic member (5) on the clamping spindle (4) in the exchange position of the clamping spindle (4).

10 Claims, 3 Drawing Sheets

ELECTRICAL TOOL WITH A QUICK-ACTION CLAMPING DEVICE

BACKGROUND OF THE INVENTION

1. Field of the Invention

The present invention relates to an electrical tool, in particular a circular saw, including a housing, a motor-driven hollow spindle for supporting a working tool and located in the housing, and a quick-action device for clamping the working tool with respect to the hollow spindle and having a clamping spindle arranged in the hollow spindle with a possibility of an axial displacement relative thereto, an elastic member for biasing the clamping spindle into its clamping position in which the working tool is clamped between a clamping flange, which is provided on a working tool-side end of the clamping spindle, and the hollow spindle, and actuation means for displacing the clamping spindle against a biasing force of the elastic member into its exchange position in which the working tool is released.

2. Description of the Prior Art

As discussed above, the electrical tools of the type discussed above have a quick-action clamping device that provides for an easy exchange of the working tool, e.g., a circular saw blade, without danger of loosing the working tool. The working tool is releasably secured with a clamping flange, which is provided on the clamping spindle, as a result of the movement of the clamping spindle relative to the hollow spindle. Preferably, the quick-action clamping device includes means for formlockingly securing the working tool in the quick-action clamping device.

An electrical tool of the type described above, is disclosed, e.g., in German Patent No. 4,336,620. the disclosed tool includes a motor located in the tool housing for driving the hollow spindle, and a quick-action clamping device for receiving the working tool. The quick-action clamping device includes a clamping spindle displaceably supported in the hollow spindle coaxially therewith. The clamping spindle is axially preloaded by an elastic member. The quick-action clamping device is actuated between its clamping and release positions by a clamping lever provided at the end of the clamping spindle remote from the working tool-side end of the clamping spindle. In the clamping position of the quick-action clamping device, the working tool is clamped between the hollow spindle and the clamping flange. At the end of the clamping lever, at which the lever is supported on a pivot axis, there is provided an eccentric connected with the clamping spindle by a bolt. Upon pivoting the clamping lever into the exchange position, the eccentric displaces the clamping spindle against the biasing force of the elastic member and, as a result of frictional forces acting between the bolt and the eccentric, displaces the clamping spindle axially in a direction toward the working tool.

An advantage of the known quick-action clamping device consists in that the working tool can be exchanged without using any auxiliary tool, e.g., a spanner. For changing the working tool, a user moves the clamping lever into an exchange position and screws the clamping flange off the clamping spindle, which permits to take off the working tool and/or place a new tool in the quick-action clamping device.

A drawback of the know quick-action clamping tool consists in that in view of the manufacturing tolerances during the manufacture of the electrical tool, the quick-action clamping device should be readjusted during the final assembly.

Further, e.g., after a lasting use for a significant period of time, different expansions of elements of the clamping device, as a result of heating, adversely affect the functioning of the device. The different heat expansions of the device elements adversely affect the device behavior. In separate cases, even blocking of the quick-action clamping device is possible.

Accordingly, an object of the present invention is to provide a quick-action clamping device that would not be sensitive to manufacturing tolerances of the electrical tool in which the clamping device is used.

Another object of the present invention is to provide a quick-action clamping device that would reliably function even with a strong heating of the electrical tool.

SUMMARY OF THE INVENTION

These and other objects of the present invention, which will become apparent hereinafter, are achieved by providing a quick-action clamping device including a compensator or for interrupting action of the elastic member on the clamping spindle at least in the exchange position of the clamping spindle, of the quick-action clamping device.

Because in the exchange position, the action of the elastic member on the clamping spindle is interrupted, the elasticity of the elastic member has no influence on the position of the clamping spindle. In particular, the prevailing conditions in the exchange position do not depend on the return path of the elastic member and on the clamping force.

The compensator compensates or may even completely eliminate the influence of the difference in tolerances and the expansions, which result from the electrical tool being heated during its operation, on the functioning of the quick-action clamping device.

Advantageously, the compensator is provided at the end of the clamping spindle remote from the working tool, which permits to simplify the construction of the quick-action clamping device. Further, it is advantageous to arrange all of the actuation elements at the end of the spindle remote from the working tool. Naturally, it is also possible to arrange the compensator between the working tool and the end of the clamping spindle remote from the working tool.

Advantageously, the compensator is arranged in a operational chain between the elastic member and the clamping spindle and in operational chain between the elastic member and the actuation means.

Such an arrangement of the compensator provides for an appropriate control, in particular, for coupling and decoupling of the operational chain of the quick-action clamping device. The use of the compensator permits to reduce or even completely eliminate the influence of the tolerances or a false actuation.

Advantageously, the compensator has a stop element for decoupling the clamping spindle from the elastic member at least in the exchange position of the clamping spindle. The working tool is secured with a clamping flange that is screwed on the clamping spindle. During the exchange process, the user puts the quick-action clamping device in its exchange position with an actuation device and screws the clamping flange off the clamping spindle. The working tool is changed, and the clamping flange is again screwed on the clamping spindle for clamping the working tool. However, because the stop element decouples or separates the clamping spindle from the elastic member, the elastic member does not interfere with screwing of the clamping flange on the clamping spindle.

In order to simplify the construction of the quick-action working tool and, thereby, its manufacture, the stop element is fixedly secured at the end of the clamping spindle remote from the working tool-side of the clamping spindle. Naturally, it is also possible to arrange the stop element at the working tool-side and of the clamping spindle with the possibility of the axial displacement of the stop element or rotatably secure the stop element on the clamping spindle. However, the later arrangements are associated with increased constructional costs.

Advantageously, the stop element has a stop shoulder that at least partially projects in an axial projection region of an end region of the hollow spindle remote from the working tool, and that engages an end surface of the hollow cylinder in the exchange position of the clamping spindle. As a result of the engagement of the clamping spindle, of the stop shoulder, with the hollow spindle, the relative movement of the clamping spindle relative to the hollow spindle in the direction toward the working tool is prevented. This prevents overtwisting of the clamping flange during the exchange process. in addition, the clamping path of the movement of the clamping spindle relative to the hollow spindle is clearly defined.

Advantageously, the compensator has a transmission element that operationally connects the actuation device with the elastic member. The transmission element transmits the clamping force of the elastic member between the hollow spindle and the actuation device.

Advantageously, the transmission element is formed as a spacer sleeve having a first end surface that is operationally connected with the elastic member at least in the exchange position of the clamping spindle, and a second, opposite end surface that is operationally connected with the actuation means in the exchange position.

The spacer sleeve can be formed as a one-or multi-part element. Advantageously, the spacer sleeve is formed as a one-part element, which facilitate the final assembly. By the axial displacement of the spacer sleeve toward the hollow spindle, the action of the clamping force of the elastic member on the clamping spindle is interrupted or at least substantially reduced.

Advantageously, the spacer sleeve forms, by its working tool-side end region, a space in which the stop element is received. This insures a compact construction of the quick-action clamping device. Preferably, the spacer sleeve is formlockingly or positively connected with the clamping spindle.

In order to clearly define a maximal displacement of the clamping spindle in the clamping position of the quick-action clamping device, the clamping spindle preferably has, at its end remote from its working tool-side end, an end stop that cooperates with the elastic member.

Advantageously, the compensator also includes a damping element that is decoupled from the elastic member. The damping element can be formed, e.g., as an air clearance or gap. The axial length of the damping element is so selected that it corresponds approximately to from 0.01 to 0.1 of the inner diameter of the hollow spindle.

When the compensator includes a damping element, advantageously, the elasticity of the damping element is higher than the elasticity of the elastic member.

As it has already been mentioned above, the compensator permits to precisely define the prevailing or basic conditions during the actuation of the quick-action clamping device between the clamping and exchange positions. By the compensator, these basic conditions are at least partially decoupled from the elastic member, becoming independent from the relative movement between the clamping and hollow spindles. This permits, e.g., to select tolerances based solely on manufacturing and technical consideration, without the tolerances affecting the operation of the quick-action clamping device.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
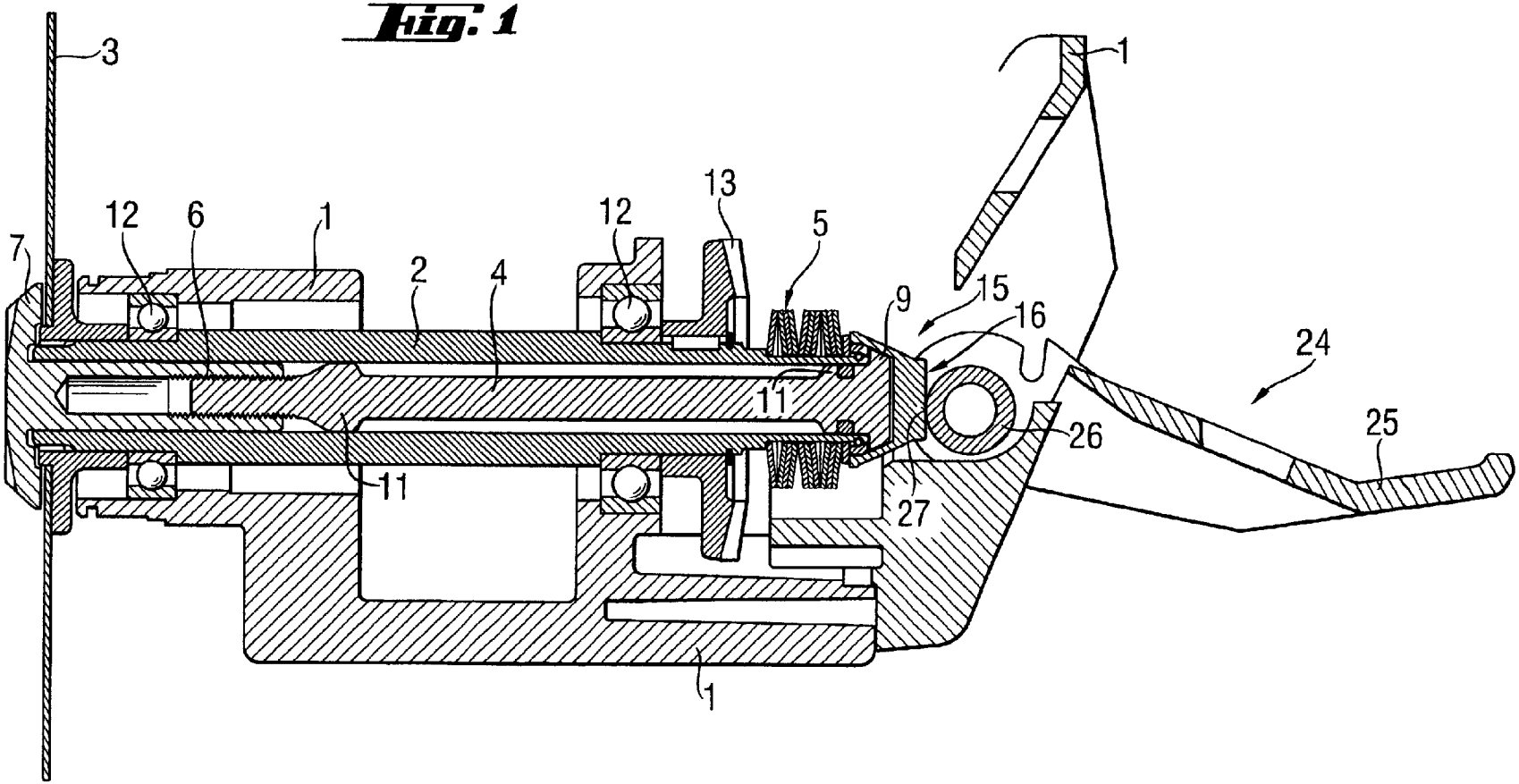
FIG. 1 a partial cross-sectional view of an electrical tool with a quick-action clamping device according to the present invention.
Figure 2:
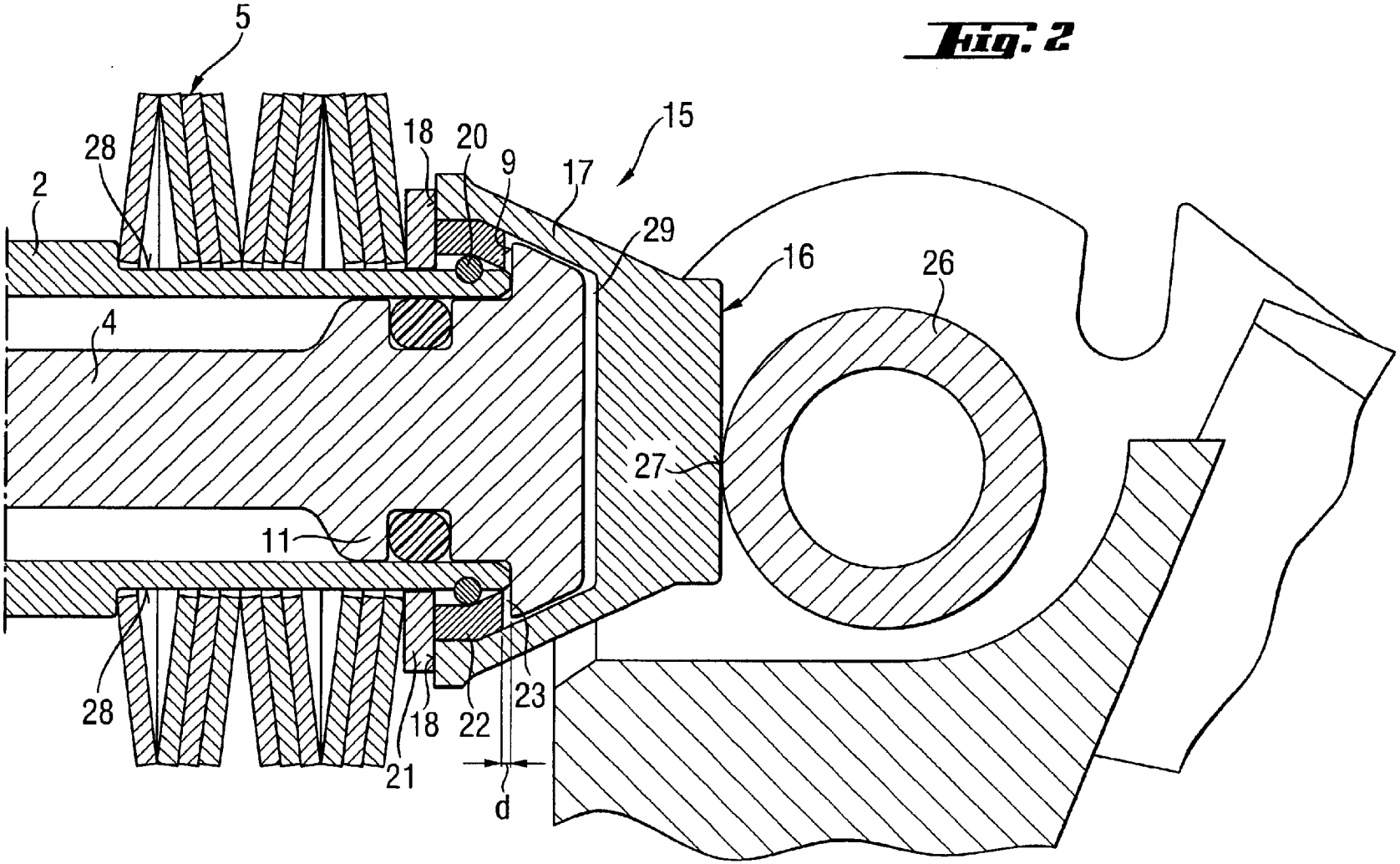
FIG. 2 a cross-sectional view of a compensator shown in FIG. 1 in its exchange position.
Figure 3:
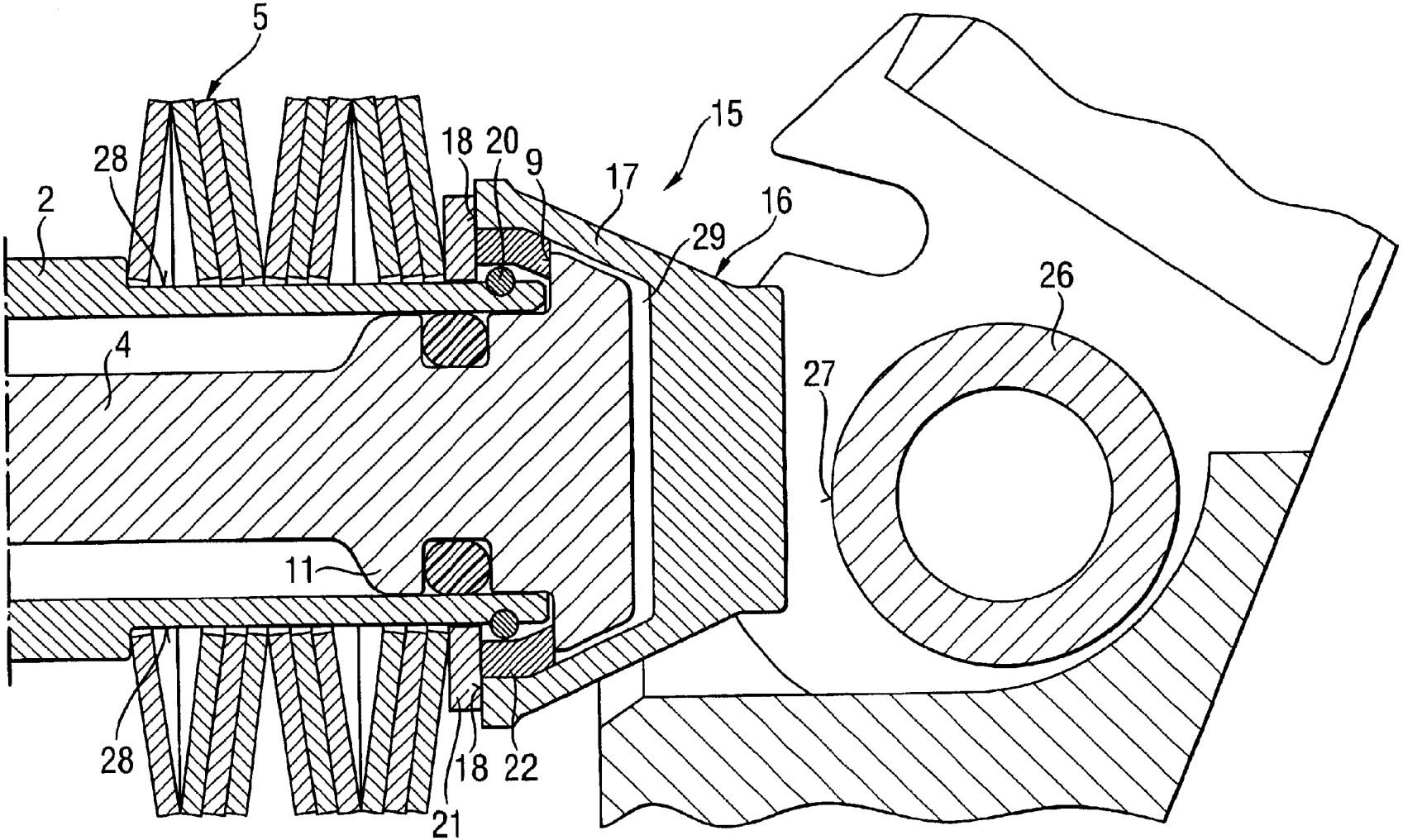
FIG. 3 a cross-sectional view of the compensator shown in FIGS. 1–2 in its clamping position.

FIGS. 1–3 show a portion of an electrical tool, in particular a circular saw, with a quick-action clamping device according to the present invention which is arranged in the housing 1 of the tool.

The quick-action clamping device has a motor-driven hollow spindle 2 and a clamping spindle 4 which is displaceably arranged in the hollow spindle 2 coaxially therewith. An elastic member 5 displaces the clamping spindle 4 relative to the hollow spindle 2 between a clamping position, which is shown in FIG. 3, and an exchange position shown in FIGS. 1–2. In the clamping position of the quick-action clamping device, a working tool 3 in clamped between a clamping flange 7, which is provided at a working tool-side of the clamping spindle 4, and the hollow spindle 2. The quick-action clamping device further includes a compensator 15 having a stop element and a transmission element and which interrupts the action of the elastic member 5 on the clamping spindle 4.

At its working tool end, the clamping spindle 4 has an outer thread 6 that cooperates with an inner thread provided in the clamping flange 7. At its opposite end, the clamping spindle 4 is provided with a stop element which projects in the axial projection region of an end region of the hollow spindle 2 remote from the working tool-side of the hollow spindle 2. The stop element is formed as a stop shoulder 9. In the exchange position of the quick-action clamping device, the stop shoulder 9 contacts the end surface of the hollow spindle 2, as it is clearly shown in FIG. 2. The cylindrical clamping spindle 4 has an outer diameter which is smaller than the inner diameter of the hollow spindle 2. Between its opposite ends, the clamping spindle 4 has two guide regions 11 the cylindrical outer surfaces of which have a diameter that approximately corresponds to the inner diameter of the hollow cylinder 2, thus insuring a somewhat central guidance of the clamping spindle 4 in the hollow spindle 2.

The hollow spindle 2 is rotatably supported in the electrical tool housing 1 by two ball bearings 12. A torque, which is generated by a motor, e.g., electrical motor, is transmitted to the hollow spindle 2 via a tooth gear 13 fixedly secured on the hollow spindle 2. The hollow spindle 2 transmits the torque to the working tool 3. At the end region of the hollow spindle 2 remote from its working tool-side, there is provided an O-ring, in particular a snap ring, that forms a end stop 20 for the elastic member 5.

The elastic member 5 can be formed, e.g., as an O-shaped spring pack arranged in an outwardly opening neck 28 formed on the hollow spindle 2 at its end remote from its working tool-side end.

A compensator 15, which is provided at the end of the hollow spindle 2 remote from working tool-side of the hollow spindle 2, includes a pot-shaped spacer sleeve 16 in which stop shoulder 9 of the clamping spindle 4 is received. The spacer sleeve 16 serves as a transmission element between an actuation device 24 and the clamping spindle 4 and between the actuation device 24 and the elastic member 5. The free end surface 18 of the sleeve-shaped region 17 of the spacer sleeve 16, which faces in a direction toward the working tool 3, forms a stop surface. The compensator 15 further includes an O-shaped, load ring 21 which is located between the end surface 18 of the spacer sleeve 16 and an end of the elastic member 5 facing in a direction away from the working tool 3. The load or support ring 21 extends radially from the outer surface of the hollow spindle 2 and approximately up to a maximal outer circumference of the spacer sleeve 16. The compensator 15 further includes an O-shaped spacer ring 22 the inner diameter of which is larger than an outer diameter of the end stop 20. The spacer ring 22, together with the stop element, in particular with the stop shoulder 9, in arranged in a space 29 of the spacer sleeve 16. A damping element 23 is arranged between the spacer ring 22 and the stop shoulder 9. The damping element 23 had an axial length d. The damping element 23 has a higher elasticity than the elastic member 5 that is formed, e.g., of rubber. In the embodiment shown in the drawings, the damping element is simply air. The length d of the damping element 23 corresponds approximately to 0.05 of the inner diameter of the hollow spindle 2.

For actuation of the quick-action clamping device, the actuation device 24, which is provided at the end of the clamping spindle 4 remote from the working tool-side of the spindle 4, is used. The actuation device 24 has a handle 25 eccentrically pivotally supported on the housing 1, and an eccentric roller 26. The eccentric roller 26 has a contact surface 27 engageable with the spacer sleeve 16. Because the contact surface 27 is arranged eccentrically with respect to the pivot axis of the handle 25, a pivotal movement of the handle 25 results in an axial displacement of the spacer sleeve 16.

In the exchange position of the quick-action clamping device, the spacer sleeve 16 transmits a force, which is applied thereto by the eccentric roller 26, to the elastic member 5. In this way, the bias of the clamping spindle 4 against the hollow spindle 2 is lifted, and the spacer sleeve 16 decouples the clamping spindle 4 from the elastic member 5.

The stop shoulder 9 is formed integrally with the clamping spindle 4 as a one-piece part. Upon assembly of the quick-action clamping device, the spacer sleeve 16 is displaced over the stop shoulder 9, whereby pressure is applied to the spacer ring 22, and the clamping spindle 4 becomes positively connected with the spacer sleeve 16. However, the clamping spindle 4 has a limited freedom of axial movement in the space 29.

In the exchange position of the quick-action clamping device, which is shown in FIGS. 1–2, the eccentric roller 26 applies pressure to the spacer sleeve 16 with its contact surface 27. The axially stationary hollow spindle 2, which is secured in the housing 1, and the spacer sleeve 16 absorb, in the exchange position of the quick-action clamping device, the tension force of the elastic member 5. In this exchange position, the stop shoulder 9 which, as discussed above, is formed integrally with the clamping spindle 4, contacts the end surface of the hollow spindle 2 remote from the working tool-side of the hollow spindle 2. A clearance between the spacer sleeve 16 and the clamping spindle 4, which is clearly shown in FIG. 2, should always be retained. Due to the absence of the bias of the clamping spindle 4 against the hollow spindle 2, a screw-down of the clamping flange 7 can be effected without application of any significant force or without using auxiliary means.

As shown in FIG. 3, which shows a clamping position of the quick-action clamping device according to the present invention, the eccentric roller 26 is spaced from the spacer sleeve 16 in the clamping position. The elastic member 5 preloads the spacer sleeve 16 against the hollow spindle 2, on one hand, and on the other hand, the elastic member 5 likewise preloads the clamping spindle 4 against the hollow spindle 2. The working tool 3 is clamped, in the clamping position of the quick-action clamping device between the hollow spindle 2 and the clamping flange 7, which is screwed on the clamping spindle 4.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. An electrical tool, comprising a housing (1); a motor-driven hollow spindle (2) for supporting a working tool (3) and located in the housing (1); and a quick-action device for clamping the working tool (3) with respect to the hollow spindle (2), the quick-action clamping device having a clamping spindle (4) arranged in the hollow spindle (2) with a possibility of an axial displacement relative thereto, an elastic member (5) for biasing the clamping spindle (4) into a clamping position thereof, in which the working tool is clamped between a clamping flange (7) provided on a working tool-side end of the clamping spindle (4) and the hollow spindle (2), actuation means (24) for displacing the clamping spindle (4) against the biasing force of the elastic member (5) into an exchange position thereof, in which the working tool (3) is released, a compensator (15) arranged between the elastic member (5) and the actuation means (24) for interrupting action of the elastic member (5) on the clamping spindle (4) at least in the exchange position of the clamping spindle and in response to actuation of the actuation means (24), and damping means (22) having a predetermined length and a higher elasticity than the elastic member (5) and arranged between the elastic member (5) and the clamping spindle (4).

2. An electrical tool according to claim 1, wherein the compensator (15) is provided at an end of the clamping spindle (4) remote from the working tool-side of the clamping spindle.

3. An electrical tool according to claim 1, wherein the compensator (15) has a stop element for decoupling the clamping spindle (4) from the elastic member (5) at least in the exchange position of the clamping spindle (4).

4. An electrical tool according to claim 3, wherein the stop element is fixedly secured at the end of the clamping spindle (4) remote from the tool-side end of the clamping spindle.

5. An electrical tool according to claim 3, wherein the stop element comprises a stop shoulder (9) that at least partially projects in an axial projection region of an end region of the hollow spindle (2) remote from the working tool (3), the stop shoulder (9) engaging an end surface of the hollow spindle (2) in the exchange position of the clamping spindle (4).

6. An electrical tool according to claim 3, wherein the compensator has a transmission element for operationally connecting the actuation means (24) with the elastic member (5).

7. An electrical tool according to claim 6, wherein the transmission element comprises a spacer sleeve (16) having a first end surface (18) that is operationally connected with the elastic member (5) at least in the exchange position of the clamping spindle (4), and a second, opposite end surface that is operationally connected with the actuation means (24) in the exchange position.

8. An electrical tool according to claim 7, wherein the spacer sleeve (16) forms, by a tool-side end region thereof, a receiving space for the stop element.

9. An electrical tool according to claim 1, wherein the clamping spindle (4) is provided at an end thereof remote from the working tool, with an end stop (20) for limiting a biasing force applied by the elastic member (5) to the clamping spindle (4).

10. A quick-action clamping device for an electrical tool including a hollow spindle (2) for supporting a working tool (3) the clamping device comprising a clamping spindle (4) arranged in the hollow spindle (2) of the electrical tool, an elastic member (5) for biasing the clamping spindle (4) into a clamping position, in which the working tool is clamped between a clamping flange (7) provided on a working tool-side end of the clamping spindle (4) and the hollow spindle (2), an actuation element (24) for displacing the clamping spindle (4) against the biasing force of the elastic member and into an exchange position in which the working tool (3) is released, a compensator (15) arranged between the elastic member (5) and the actuation means (24) for interrupting action of the elastic member (5) on the clamping spindle (4) at least in the exchange position thereof in response to actuation of the actuation means (24), and damping means (22) having a predetermined length and a higher elasticity than the elastic member (5) and arranged between the elastic member (5) and the clamping spindle (4).

* * * * *